US006727453B2

(12) United States Patent
Skarby et al.

(10) Patent No.: US 6,727,453 B2
(45) Date of Patent: Apr. 27, 2004

(54) HYBRID CIRCUIT BREAKER WITH A TRANSMISSION

(75) Inventors: Per Skarby, Alströmersgatan (SE); Andreas Nohl, Zürich (CH); Stephan Grob, Baden (CH); Mattias Lundborg, Ludvika (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 10/285,518

(22) Filed: Nov. 1, 2002

(65) Prior Publication Data

US 2003/0089682 A1 May 15, 2003

(30) Foreign Application Priority Data

Nov. 9, 2001 (EP) ..... 01811082

(51) Int. Cl.[7] ..... H01H 9/40

(52) U.S. Cl. ..... 218/7; 218/3; 218/78; 218/154

(58) Field of Search ..... 218/1–7, 14, 17, 218/19, 20, 78, 84, 120, 140, 154, 69, 70, 124, 153

(56) References Cited

U.S. PATENT DOCUMENTS 4,440,996 A * 4/1984 Calvino ..... 218/57
5,155,315 A * 10/1992 Malkin et al. ..... 218/3
5,668,360 A * 9/1997 Perret et al. ..... 218/5
5,905,242 A * 5/1999 Bernard et al. ..... 218/16
6,545,241 B1 * 4/2003 Franchi et al. ..... 218/78

FOREIGN PATENT DOCUMENTS

| | | |
|---|---|---|
| EP | 0847586 B1 | 4/1999 |
| WO | WO86/04452 | 7/1986 |
| WO | WO97/08723 | 3/1997 |

* cited by examiner

*Primary Examiner*—Ann Mai
*Assistant Examiner*—M. Fishman
(74) *Attorney, Agent, or Firm*—Burns, Doane, Swecker & Mathis, L.L.P.

(57) ABSTRACT

The hybrid circuit breaker has at least two series-connected arcing chambers, which are operated by a commmon drive via a transmission (29) connected upstream from it. It is intended to be possible to assemble this transmission (29) easily in the interior of the hybrid circuit breaker. This is achieved in that the transmission (29) is formed from at least two transmission parts which can be plugged together, with a first transmission part being firmly connected to the at least one first arcing chamber and a second transmission part being firmly connected to the at least one second arcing chamber. The transmission (29) also has means which allow the movements of the at least two arcing chambers to be technically suitably matched to one another and to be optimized with respect to the time sequence and switching speed thereof.

7 Claims, 4 Drawing Sheets

HYBRID CIRCUIT BREAKER WITH A TRANSMISSION

This application claims priority under 35 U.S.C. §§ 119 and/or 365 to Ser. No. 01811082.5 filed in Europe on Nov. 9, 2002; the entire content of which is hereby incorporated by reference.

FIELD OF THE INVENTION

The invention is based on a hybrid circuit breaker having a transmission, as claimed in the precharacterizing clause of claim 1.

BACKGROUND OF THE INVENTION

The document EP 0 847 586 B 1 discloses a hybrid circuit breaker which can be used in an electrical high-voltage network. This hybrid circuit breaker has two series-connected arcing chambers, a first of which is filled with sulfahexafluoride gas as a quenching and insulating medium, and a second of which is in the form of a vacuum interrupter chamber. The second arcing chamber is surrounded by sulfahexafluoride gas on the outside. The main contacts of the two arcing chambers are operated simultaneously by a common drive via a simple lever transmission. Both arcing chambers have a power current path, in each of which the erosion-resistant main contacts are located and, in parallel with this, a rated current path, with this rated current path having only a single interruption point. During disconnection, the rated current path is always interrupted first of all, after which the current to be disconnected commutates onto the power current path. The power current path then continues to carry the current until it is definitively disconnected.

Simple lever transmissions such as these are comparatively difficult to match to the movement profiles required in hybrid circuit breakers. Furthermore, the bearing points are subject to mechanically very severe stresses, which results in the bearing points having a complex and expensive design, as a result of which the hybrid circuit breaker price is increased. If this configuration of the bearing points is dispensed with, then the time penalty for the maintenance work which is then required more frequently restricts the availability of the hybrid circuit breaker in a disadvantageous manner. Furthermore, the complexity for installing the lever transmission in the interior of the hybrid circuit breaker is comparatively great, owing to the restricted accessibility in this area.

SUMMARY OF THE INVENTION

The invention, as it is characterized in the independent claims, achieves the object of providing a hybrid circuit breaker having a transmission, which can be joined together easily in the interior of the hybrid circuit breaker.

The hybrid circuit breaker has at least two series-connected arcing chambers, which are operated by a common drive. These arcing chambers are preceded by a common transmission. This transmission has at least two transmission parts, which are designed such that they can be plugged together, with the first transmission part being firmly connected to the at least one first arcing chamber, and the second transmission part being firmly connected to the at least one second arcing chamber. The transmission has means which allow the movements of the at least two arcing chambers to be technically sensibly matched to one another and to be optimized with respect to the time sequence and switching speed thereof. It has been found to be particularly advantageous for the transmission to be designed such that it is self-locking both in the connected position and in the disconnected position since this means that there is no need for any additional locking apparatus or catches. Furthermore, the drive does not need to apply any particular holding forces in the two limit positions, so that a simple and particularly low-cost drive can be used here. The transmission can be installed comparatively easily, so that the time required for installation work for maintenance purposes is advantageously reduced. This simplified installation requires a comparatively short amount of time, so that the operational availability of the hybrid circuit breaker is advantageously increased.

The longitudinal axes of the two arcing chambers in one preferred embodiment of the hybrid circuit breaker lie in one plane and are inclined at an angle $\alpha$ to one another, with the angle $\alpha$ being less than 90°, and preferably being in the range between 68° and 800°. This arrangement of the arcing chambers makes it possible to produce a hybrid circuit breaker which has a comparatively short extent in the axial direction, so the space required for this hybrid circuit breaker is particularly small.

The further refinements of the invention are the subject matter of the dependent claims.

The invention, its development and the advantages which can be achieved by it are explained in more detail in the following text with reference to the drawing, which illustrates only one possible embodiment approach.

Elements having the same effect are provided with the same reference symbols in all the figures. Only those elements which are required for direct understanding of the invention are illustrated and described. In order to make the figures clearer, the majority of the viewing edges are not shown in each case.

DETAILED DESCRIPTION OF THE INVENTION

Figure 1:
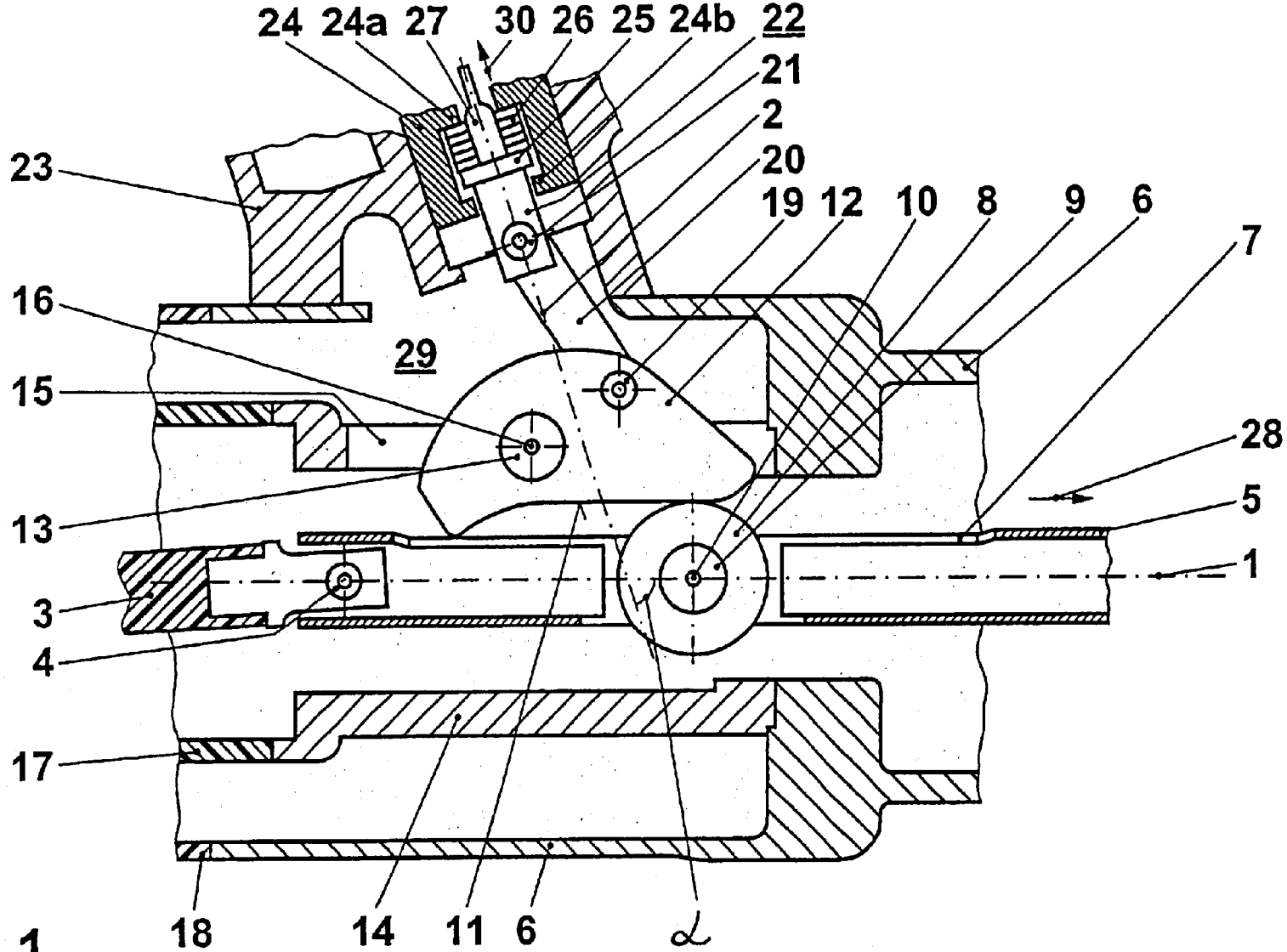
FIG. 1 shows a section through a first embodiment of the transmission, which is illustrated in a highly simplified and schematic form, and with the hybrid circuit breaker in the connected state.

FIG. 1 shows, schematically, a section through a first embodiment of a transmission 29, which is illustrated in a highly simplified form, with the hybrid circuit breaker in the connected state. This hybrid circuit breaker has two series-connected arcing chambers, which are not illustrated but in this case, by way of example, are mounted at an angle to one another. The first arcing chamber, for example an arcing chamber which is filled with insulating gas, is arranged such that it extends along a first longitudinal axis 1 and concentrically with respect to it, and the other arcing chamber, for example a vacuum interrupted chamber, is arranged such that it extends along a second longitudinal axis 2, and concentrically with respect to it. In this case, the two longitudinal axes intersect at an angle α, with this angle α preferably being in the range between 68° and 80°. The two longitudinal axes generally lie in one plane, but it is normally possible for these longitudinal axes to be provided in two planes arranged parallel to one another, or in two planes which intersect at an angle which is sensible for design purposes.

The hybrid circuit breaker is driven by a drive, which is not illustrated but is generally at ground potential, via a drive linkage 3, part of which is composed of electrically insulating material. The drive linkage 3 is connected by means of a bolt 4 to a tubular contact rod 5 which can move in the direction of the first longitudinal axis 1. The contact rod 5 operates the contact or contacts itself, depending on the nature of the arcing chamber that is filled with insulating gas. As already stated, this arcing chamber is not shown here. The contact rod 5 is arranged concentrically with respect to the first longitudinal axis 1, and is guided such that it slides axially in guide parts, which are not shown, in a stationary enclosure 6. The contact rod 5 has a slot 7, which runs parallel to the plane of the drawing. A roller 8 is mounted in this slot 7 such that it can rotate on a bolt 9 which is connected to the contact rod 5, with the rotation axis 10 running at right angles to the first longitudinal axis 1, and generally intersecting it.

The roller 8 projects upward out of the slot 7 and in this case forces a planar surface 11 of a slotted guide disk 12, which is mounted such that it can rotate, upward. In the illustrated connected position, this surface 11 runs parallel to the first longitudinal axis 1. The slotted guide disk 12 is fitted to a bolt 13. The bolt 13 is held in a guide enclosure 14, which is rigidly connected to the enclosure 6. The guide enclosure 14 has an axial slot 15, in which the slotted guide disk 12 can move in the radial direction with respect to the first longitudinal axis 1. The rotation axis 16 of the slotted guide disk 12 runs parallel to the rotation axis 10 of the roller 8. The bearing points for the roller 8 and for the slotted guide disk 12, which are in the form of sliding bearings, are provided with insulating parts, which are not illustrated but prevent stray currents from being able to flow through these bearing points, and being able to damage them, during operation. The guide enclosure 14 merges on the drive side into a schematically illustrated insulating enclosure 17. On the drive side, the enclosure 6 merges into a schematically illustrated insulating enclosure 18. These insulating enclosures 17 and 18 are fitted with the active parts of the hybrid circuit breaker. The enclosures which surround the active parts of the hybrid circuit breaker and at the same time seal the gas areas of the hybrid circuit breaker from the outside are not shown here.

A further bolt 19 is mounted in the slotted guide disk 12 such that it can rotate, and one end of a double lever 20 is hinged on it, while the other end of this double lever 20 is connected to a bolt 21 such that it can rotate. The bolt 21 is held in a contact rod 22, which operates the moving contact of a vacuum interrupter chamber, which is not illustrated. In this case, the contact rod 22 extends concentrically with respect to the second longitudinal axis 2. The enclosure 6 is firmly connected to a flange 23, to which the vacuum interrupter chamber (which is not illustrated) is fitted and which guides the contact rod 22. A stop part 24 is inserted firmly in the flange 23 and concentrically surrounds the contact rod 22. The contact rod 22 has a collar 25, on which a cup spring pack 26 is supported. The cup spring pack 26 is 6 guided centrally through a cylindrical step 27 on the contact rod 22. The cup spring pack 26 is supported against a first shoulder 24 a on the stop part 24, on the side opposite the collar 25. The cup spring pack 26 is in this case prestressed in the connected position, and ensures that the contacts of the connected vacuum interrupted chamber are always pressed against one another with the necessary contact force.

A first arrow 28 indicates the direction, in this case to the right, in which the drive (which is not illustrated) for the drive linkage 3 and, via it, the contact rod 5 which produces the connection movement of the arcing chamber that is filled with insulating gas, has moved. The transmission 29 converts this axial movement with the contact rod 5 to a movement of the contact rod 22 in a direction which is indicated by a second arrow 30, in this case pointing obliquely upward in the direction of the second longitudinal axis 2. The following parts interact in the transmission 29; the contact rod 5 interacts with the roller 8 on its bearings, the slotted guide disk 12, the bolts 13 and 19, the double lever 20, the bolt 21 and the contact rod 22, and the transmission 29 is operated by the drive linkage 3. The transmission 29 links the movements of the two arcing chambers to one another, and technically matches the movement sequences sensibly to one another. The transmission 29 is designed such that it acts in a self-locking manner in the connected position, that is to say the hybrid circuit breaker is held in this position even in the event of vibration, without any additional locking and without any need for the drive to apply force.

Figure 2:
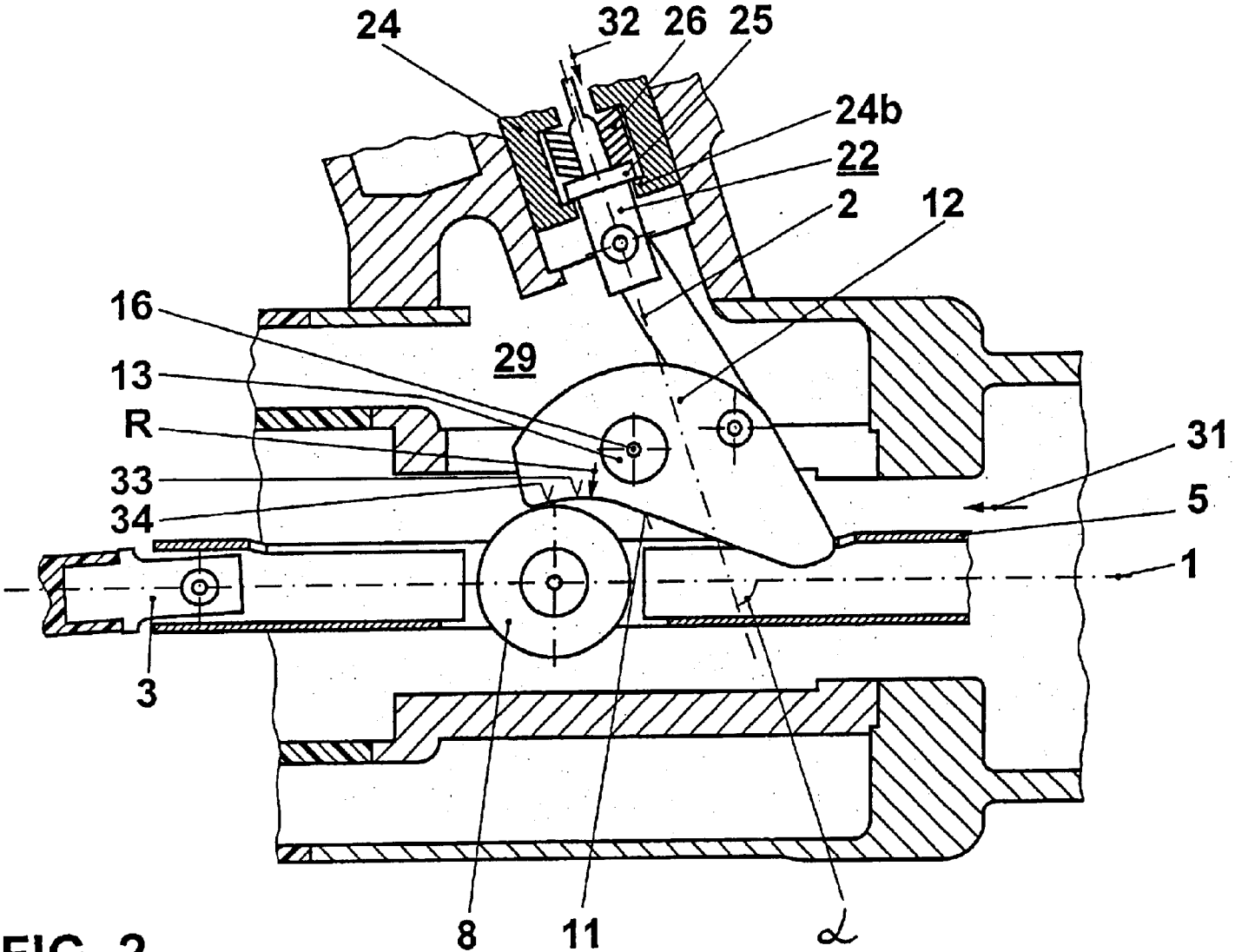
FIG. 2 shows the first schematically illustrated embodiment of the transmission in the disconnected state.

FIG. 2 shows a schematically illustrated section through the first embodiment of the transmission 29, which is illustrated in highly simplified form, with the hybrid circuit breaker in the disconnected state. An arrow 31 indicates the direction of the disconnection movement, in this case to the left, in which the drive (which is not illustrated) has moved the drive linkage 3 and, via this, the contact rod 5, which causes the disconnection movement of the arcing chamber that is filled with insulating gas. The transmission 29 converts this axial movement of the contact rod 5 to a movement of the contact rod 22 in a direction which is indicated by a second arrow 32, and which in this case is obliquely downward in the direction of the second longitudinal axis 2. The disconnection movement is complete when the collar 25 of the contact rod 22 strikes the shoulder **24*b* of the stop part 24, and there is then virtually no stress on the cup spring pack 26**.

At the start of the disconnection movement, the roller 8 moves along the planar surface 11 of the slotted guide disk 12, with the prestressed cup spring pack 26 pressing the slotted guide disk 12 against the roller 8. A curved surface 33 with a radius of curvature R is tangentially adjacent to the planar surface 11. The radius of curvature R is slightly larger than the radius of the roller 8, so that the roller 8 cannot become jammed when it reaches this area. As soon as the roller 8 reaches the curved surface 33, it presses with the force of the drive against this curved surface 33, and the slotted guide disk 12 starts to rotate in the clockwise direction about the rotation axis 16, with this rotary movement being supported by the energy stored in the cup spring pack 26. The rotary movement of the slotted guide disk 12 is matched to the predetermined linear travel of the vacuum interrupter chamber. Immediately before the vacuum interrupter chamber reaches the disconnected position, the curved surface 33 of the slotted guide disk 12 merges into a planar surface 34 which runs tangentially with respect to the roller 8. On reaching the disconnected position, the roller 8 holds the vacuum interrupter chamber in its open position by means of the slotted guide disk 12 and by means of the further elements which are connected to it. The transmission 29 is thus designed such that it is also self-locking in the disconnected position, that is to say the hybrid circuit breaker is held in this position even in the event of vibration, without any additional locking and without any need for the drive to apply force.

The movement sequence of the vacuum interrupter chamber is optimally matched to the arcing chamber, which is filled with insulating gas, by virtue of the external shape of the slotted guide disk 12. Furthermore, this slotted guide disk 12 controls the time sequence of the movement of the vacuum interrupter chamber with respect to the movement of the arcing chamber that is filled with insulating gas so that, by way of example, modifications to the timing of the movement sequence can be achieved very easily by moving the roller 8 in the direction of the first longitudinal axis 1.

Figure 3:
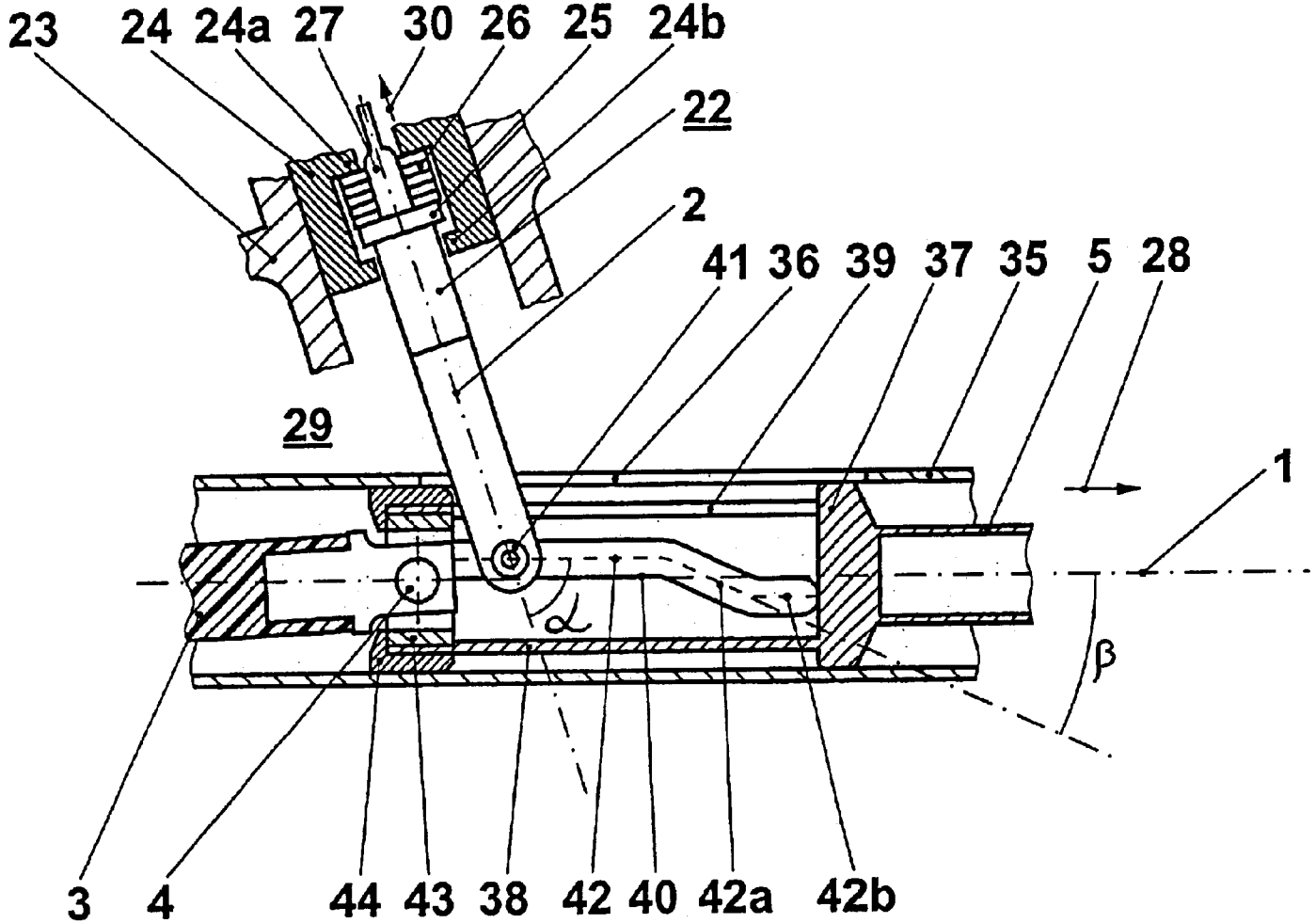
FIG. 3 shows a section through a second embodiment of the transmission, which is illustrated in a highly simplified and schematic form, and with the hybrid circuit breaker in the connected state.

FIG. 3 shows a section through a second embodiment of a transmission 29, which is illustrated in highly simplified form and schematically, with the hybrid circuit breaker in the connected state. The arcing chamber, which is filled with insulating gas, extends along a first longitudinal axis 1 and is arranged concentrically with respect to it, while the other arcing chamber, for example a vacuum interrupter chamber, extends along a second longitudinal axis 2 and is arranged concentrically with respect to it. In this case, the two longitudinal axes intersect at an angle $\alpha$. The two longitudinal axes generally lie in one plane, but it is also possible for these longitudinal axes to be provided in two planes which are arranged parallel to one another or in two planes which intersect at an angle which is sensible from the design point of view. The arcing chamber, which is filled with insulating gas, is operated by a contact rod 5. Of the other active parts of this arcing chamber, only a metallic guide tube 35 is shown here, which has an axially extending slot 36 pointing upward, and which is rigidly connected to the arcing chamber. A collar 37 on the contact rod 5 is guided such that it slides in this guide tube 35.

On the drive side, a cylindrical slotted guide part 38 is attached to this collar 37 and likewise has an axially extending slot 39 pointing upward in the region of the slot 36. The slotted guide part 38 is provided with a coincident guide slot 40 both on the front face and on the rear face. A cylindrical bolt 41 is guided in the two guide slots 40 and is fitted in the center, between the two guide slots 40, with the contact rod 22, which operates the vacuum interrupter chamber. The contact rod 22 is flattened in the region of the slots 36 and 39, so that these slots 36 and 39 can be designed to be comparatively narrow, so that they only insignificantly weaken the carrying capacity of the guide tube 35 and of the slotted guide part 38. The axis of the bolt 41 is at right angles to the plane of the drawing, and the bolt 41 can move, during switching, along a dashed line of action 42, which is at the same time the center line of the guide slots 40. The dashed line of action 42 initially runs parallel to the first longitudinal axis 1, and a section 42*a* of the dashed line of action 42 is then inclined at an angle $\beta$ to the first longitudinal axis I before once again then merging into a section 42*b* which runs parallel to the first longitudinal axis 1. The larger the angle $\beta$, the higher is the disconnection speed, as well as the connection speed, of the vacuum interrupter chamber. If the transition of the dashed line of action 42 is shifted axially from the parallel section to the inclined section 42*a*, then the switching times of the two arcing chambers can be matched to one another.

On the drive side, the two guide slots 40 are open, so that when the transmission 29 is being installed, the bolt 41 can be inserted from this side into the two guide slots 40 in the slotted guide part 38. It is also possible to widen the guide slots 40 roughly in the form of a funnel on the drive side, in order to make it easier to insert the bolt 41. Once the bolt 41 has been inserted, the drive linkage 3 is inserted from the drive side, and the bolt 4 and its holder 43 are mounted such that they can rotate on each end facing the slotted guide part 38. The holder 43 is centered by the slotted guide part 38 and is pressed against it in a force-fitting manner by means of a union nut 44 that is screwed to the slotted guide part 38, and is thus held in position. The union nut 44 is firmly tightened and secured from the drive side. This makes it very much easier to install the transmission 29. No complex installation or adjustment work is required in the interior of the transmission 29, thus allowing advantageously fast installation.

This second embodiment of the transmission 29 is likewise self-locking not only in the connected position but also in the disconnected position. No complex additional locks or additional holding forces to be applied by the drive are required, thus advantageously reducing the price of the hybrid circuit breaker.

Figure 4:
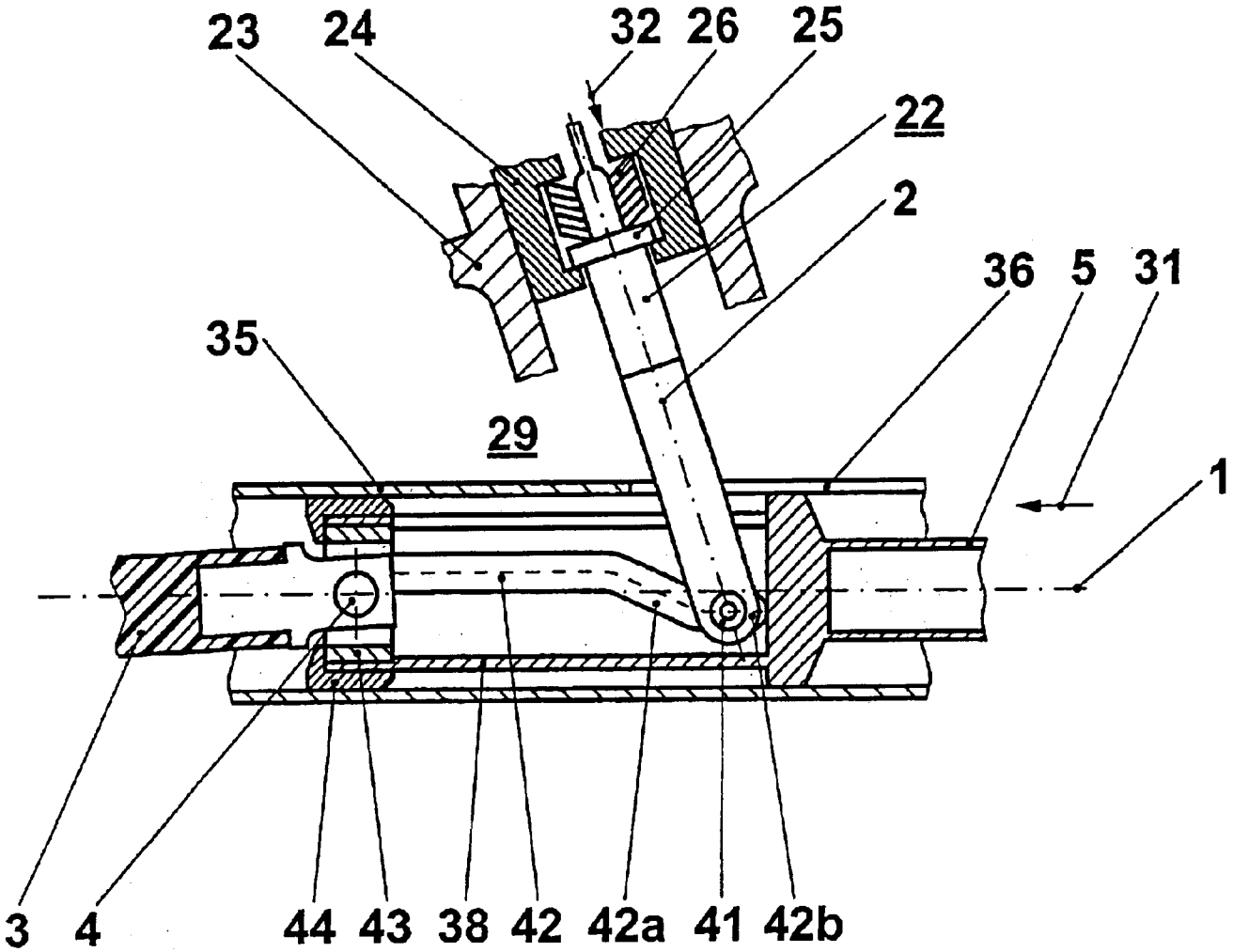
FIG. 4 shows the second schematically illustrated embodiment of the transmission in the disconnected state.

FIG. 4 shows a schematically illustrated section through the second embodiment of the transmission 29, which is illustrated in highly simplified form, with the hybrid circuit breaker in the disconnected state. The arrow 31 indicates the direction of the disconnection movement, in this case to the left, in which the drive, which is not illustrated, has moved the drive linkage 3 and, via it, the contact rod 5, which produces the disconnection movement of the arcing chamber which is filled with insulating gas. The transmission 29 converts this axial movement of the contact rod 5 to a movement of the contact rod 22 in a direction which is indicated by a second arrow 32, which in this case is obliquely downward in the direction of the second longitudinal axis 2. At the start of the disconnection movement, the bolt 41 slides to the right along the dashed lines of action 42. Since the dashed lines of action 42 initially run parallel to the first longitudinal axis 1, the pressure of the prestressed cup spring pack 26 cannot initially produce any movement of the contact rod 22 in the direction of the arrow 32. As soon as the bolt 41 reaches the inclined section 42*a*, the movement of the vacuum interrupter chamber in the disconnection direction starts. The disconnection movement of the vacuum interrupter chamber is complete when the collar 25 on the contact rod 22 strikes against the shoulder 24*b* on the stop part 24, and there is then virtually no stress on the cup spring pack 26. The bolt 41 has then reached the section 42*b* of the dashed line of action 42. The vacuum interrupter chamber is then held in the disconnected position by the contact rod 22.

Since the transmission 29 can be installed easily, this advantageously reduces the time required for installation work during maintenance tasks, the installation process is highly simplified and the operational availability of the hybrid circuit breaker is advantageously increased. The two illustrated embodiments of the transmission 29 are self-locking not only in the connected position but also in the disconnected position. There is therefore no need for any complex additional locks or additional holding forces to be applied by the drive, which advantageously reduces the price of hybrid circuit breaker.

LIST OF DESIGNATIONS

| | |
|---|---|
| 1 | First longitudinal axis |
| 2 | Second longitudinal axis |
| 3 | Drive linkage |
| 4 | Bolt |
| 5 | Contact rod |
| 6 | Enclosure |
| 7 | Slot |
| 8 | Roller |
| 9 | Bolt |
| 10 | Rotation axis |
| 11 | Surface |
| 12 | Slotted guide disk |
| 13 | Bolt |
| 14 | Guide enclosure |
| 15 | Slot |
| 16 | Rotation axis |
| 17, 18 | Insulating enclosure |
| 19 | Bolt |
| 20 | Double lever |
| 21 | Bolt |
| 22 | Drive rod |
| 23 | Flange |
| 24 | Stop part |
| 24a, 24b | Shoulder |
| 25 | Collar |
| 26 | Cup spring pack |
| 27 | Step |
| 28 | Arrow |
| 29 | Transmission |
| 30, 31, 32 | Arrow |
| 33 | Curved surface |
| 34 | Planar surface |
| 35 | Guide tube |
| 36 | Slot |
| 37 | Collar |
| 38 | Slotted guide part |
| 39 | Slot |
| 40 | Guide slot |
| 41 | Bolt |
| 42 | Dashed line of action |
| 42a, 42b | Section |
| 43 | Holder |
| 44 | Union nut |
| a | Angle |
| b | Angle |
| R | Radius of curvature |

What is claimed is:

1. A transmission for a hybrid circuit breaker having at least two series-connected arcing chambers that each extend along a longitudinal axis, which are operated by a common drive via the transmission, wherein the transmission is formed from at least two transmission parts which can be brought into contact with each other such that a guided surface of a first one of said at least two transmission parts is guided along a guiding surface of a second one of said at least two transmission parts, said first transmission part being adapted to be firmly connected to a first arcing chamber and said second transmission part being adapted to be firmly connected to a second arcing chamber, and wherein a shape of at least one of said guided surface and said guiding surface is selected according to desired relative movement between the first and second transmission parts and therefore between the first and second arcing chambers.

2. The transmission as claimed in claim 1, wherein the transmission is designed to be self-locking both in a first position corresponding to a connected position of the first and second arcing chambers and in a second position corresponding to a disconnected position of the first and second arcing chambers.

3. The transmission as claimed in claim 1, wherein the two longitudinal axes of the at least two arcing chambers lie in one plane and intersect at an angle $\alpha$, and wherein the angle $\alpha$ is less than 90°.

4. The transmission as claimed in claim 1, wherein the first transmission part comprises a slotted guide disk which is mounted such that it can rotate and the second transmission part comprises a roller which engages with said slotted guide disk, with the roller being adapted to be firmly connected to the at least one second arcing chamber, and the slotted guide disk being adapted to be firmly connected to the at least one first arcing chamber, and wherein a rotation axis of the slotted guide disk and a rotation axis of the roller run parallel to one another.

5. The transmission as claimed in claim 1, wherein the transmission has a slotted guide part with at least one guide slot and a bolt which engages in the at least one guide slot, with the slotted guide part being adapted to be firmly connected to at least one first arcing chamber, and the bolt being adapted firmly connected to the at least one second arcing chamber.

6. The transmission as claimed in claim 5, wherein at least one securing element is provided, which prevents the bolt which engages in at least one guide slot from sliding out.

7. The transmission as claimed in claim 6, wherein the securing element is in the form of a union nut.

* * * * *